United States Patent [19]

Oliver

[11] 4,222,419

[45] Sep. 16, 1980

[54] LOG SPLITTER

[75] Inventor: David P. Oliver, Winnipeg, Canada

[73] Assignee: Oliver Design Specialties Ltd., Winnipeg, Canada

[21] Appl. No.: 18,523

[22] Filed: Mar. 8, 1979

[51] Int. Cl.[3] ..... B27L 7/00

[52] U.S. Cl. ..... 144/193 R; 74/144

[58] Field of Search ..... 144/3 K, 193 R, 193 A, 144/194, 323; 74/37, 27, 112, 144, 148, 156, 160

[56] References Cited

U.S. PATENT DOCUMENTS

| | | | |
|---|---|---|---|
| 1,310,660 | 7/1919 | Inman | 144/193 R |
| 1,457,966 | 6/1923 | Eastman | 144/193 R |
| 1,803,902 | 5/1931 | Grupe | 144/193 R |
| 2,446,585 | 8/1948 | Hanners | 144/193 R |
| 4,133,359 | 1/1979 | Jensen et al. | 144/193 R |

*Primary Examiner*—W. Donald Bray
*Attorney, Agent, or Firm*—Stanley G. Ade

[57] ABSTRACT

An electrically driven log splitter comprises a frame with a double wedge assembly on one end and a ram carriage slidable along the frame towards and away from the wedge assembly so that a log on the frame will be engaged against the wedge assembly and be split thereby when the ram carriage engages the other end of the log. An electric motor drives an endless chain at a constant speed with the chain extending around sprockets mounted on the frame and being driven by the electric motor through reduction components. The ram carriage mounts a pair of sprockets with the chain passing over one sprocket and under the other. This permits the carriage to be moved manually along the frame with the chain idling over these two sprockets. A log is mounted on the frame against the wedge assembly and the carriage is moved manually along the frame to engage the rear end of the log with the chain idling around the two sprockets within the carriage. An operating handle with a pin extending therefrom is pivotally mounted on the carriage and is moved to engage the pin with the teeth of one of the sprockets thus locking the carriage to the chain which moves the carriage against the log and forces it into the wedge assembly thus splitting the log. A rod extends rearwardly of the lever and passes through an apertured disengaging plate. The rod has an adjustable stop on the distal end thereof which strikes the plate when the carriage is at the end of its travel thus disengaging the pin from the sprocket at this point.

27 Claims, 8 Drawing Figures

LOG SPLITTER

BACKGROUND OF THE INVENTION

This invention relates to new and useful improvements in log splitting assemblies.

Conventionally, most log splitters are operated hydraulically and include an hydraulic piston and cylinder assembly, which when operated, pushes a log against a wedge component thus splitting the log. While these are generally satisfactory, they suffer from one principal disadvantage and that is the expense of the components making up such hydraulic log splitters. Not only do they include the hydraulic piston and cylinder assembly which acts as a ram, but they also include an hydraulic fluid reservoir, an hydraulic fluid pump and a relatively heavy-duty source of power to operate the pump as it will be appreciated that such piston and cylinder assemblies are direct operating and need considerable pressure in order to move the log onto the wedge with sufficient force to split the log.

SUMMARY OF THE INVENTION

The present invention overcomes this disadvantage by providing a relatively simple structure which is adapted to be operated by a relatively low horsepower electric motor adapted, under normal conditions, to be driven from 110 VAC line voltage.

In accordance with the invention, there is provided a log splitting assembly having a source of power and comprising in combination a frame including a track component mounted thereon, a fixed wedge assembly on one end of said track component, a ram carriage on said track component, means mounting said ram carriage for sliding movement along said track component in either direction, an endless chain mounted within said frame and being operatively connected to the source of power, means in said frame mounting said endless chain for movement by said source of power, sprocket means mounted for rotation in said ram carriage, said endless chain engaging around said sprocket means, and means co-operating with said carriage to change said carriage from a free wheeling mode to a chain connected mode and vice versa, said carriage, when in said free wheeling mode, being movable manually in either direction along said track component and being operatively fixed to said chain for movement therealong said carriage, when in said chain connected mode.

Another advantage of the present invention is the provision of speed reduction means between the source of power and the carriage which enables sufficient pressure to be generated by the carriage in order to move the log against the wedge assembly so that the log may be split thereby.

Another advantage of the present invention is to provide a drive means for the carriage which includes chain idling means therein so that the carriage can be moved manually in either direction along the track with the chain moving at all times. When it is desired to engage the carriage with the chain, a simple lever is actuated so that the carriage in effect becomes locked to the chain and is moved along the track by the chain.

A still further advantage of the present invention is to provide means whereby the operating handle is disengaged from the sprocket when the carriage has reached a predetermined position along the track thus preventing damage occurring to the carriage or the wedge assembly.

A still further advantage of the present invention is to provide a device of the character herewithin described which includes a two stage wedge assembly with one wedge component being in advance of another wedge component thus facilitating the splitting action on the wedge assembly when a log is engaged thereby. This reduces the power required to split the logs.

Still another advantage of the present invention is to provide a device of the character herewithin described which is simple in construction, economical in manufacture compared to conventional log splitting devices, and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
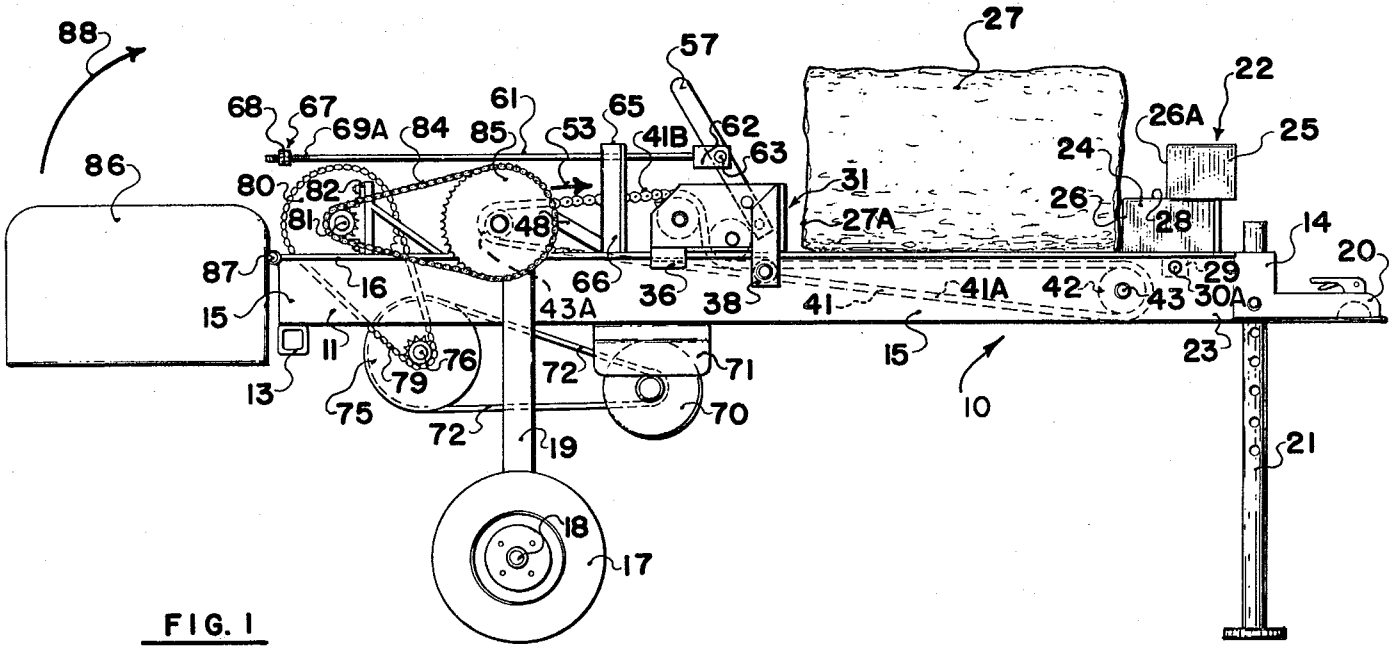
FIG. 1 is a side elevation of the device showing a log thereon.
Figure 4:
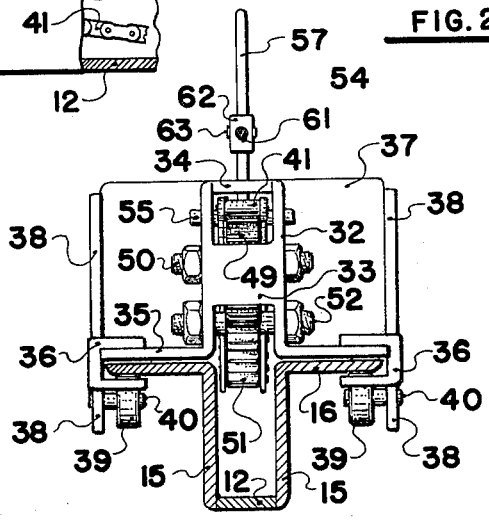
FIG. 4 is a cross sectional view of the track and frame along the lines 4—4 of FIG. 2.

Proceeding therefore to describe the invention in detail, reference character 10 illustrates the frame of the device which, in this embodiment, includes a pair of spaced and parallel longitudinally extending angle iron members 11 maintained in the desired spaced apart relationship by means of various cross members such as 12 in FIG. 4, 13 in FIG. 1, and 14 in FIG. 1 which spans the front end of the frame members.

These angle irons include the vertical flanges 15 thereof and outwardly facing horizontal flanges 16 which form a track component as will hereinafter be described.

Figure 6:
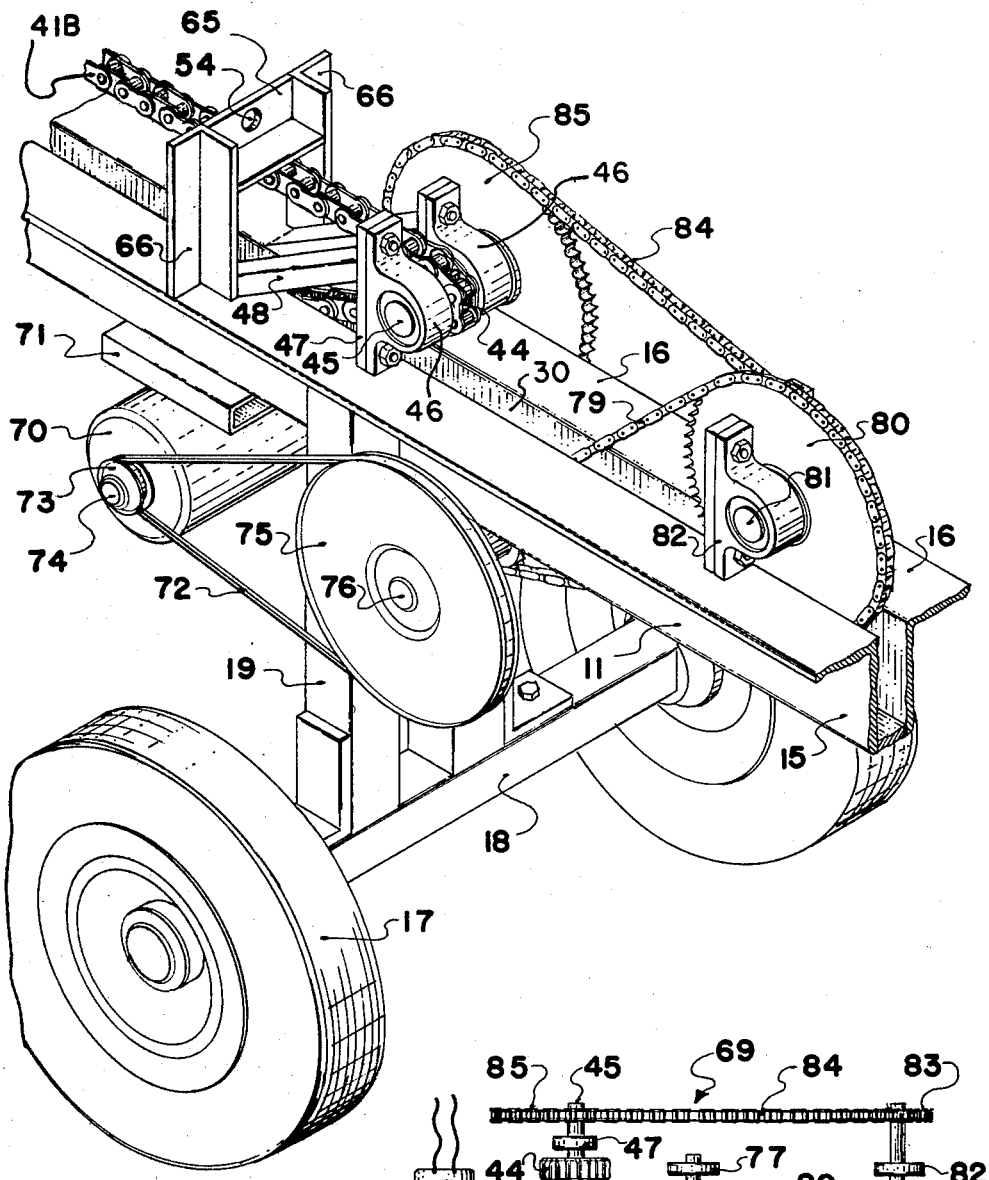
FIG. 6 is a fragmentary isometric view of the device showing the drive assembly and the ground engaging wheel assembly.

Ground engaging wheels 17 are journalled for rotation upon an axle 18 in turn secured to downwardly depending members 19 welded to the vertical flanges 15 of the angle irons 11 as clearly shown in FIG. 6.

If desired, a hitch component 20 may be provided in the front of the frame with an adjustable steady rest 21 of conventional construction, which may be extended downwardly to the supporting surface in order to support the assembly substantially horizontally.

A wedge assembly is provided collectively designated 22 and is situated upon the frame adjacent the front end 23 thereof. This wedge assembly may take any conventional form but preferably consists of a first wedge component 24 and a second wedge component 25.

The first wedge component 24 includes the wedging end 26 facing rearwardly along the track so that a log 27 may be engaged thereby.

The second wedging component 25 is secured on the upper surface 28 of the first wedging component 24 and also includes a wedging end 26A facing in the same direction as the wedging end 26 but being situated rearwardly of the wedging end 26 so that the log is engaged by the wedging end 26 prior to being engaged by the wedging end 26A. This facilitates the splitting of the log and results in lower power being required for the splitting action.

This wedging assembly is secured to and upon the flanges 16 by means of downwardly depending lugs 29 extending between the slot 30 formed by the vertical flanges 15 and is bolted in position by means of bolt assembly 30A extending through the lugs 29 and through the vertical flanges 15.

Figure 2:
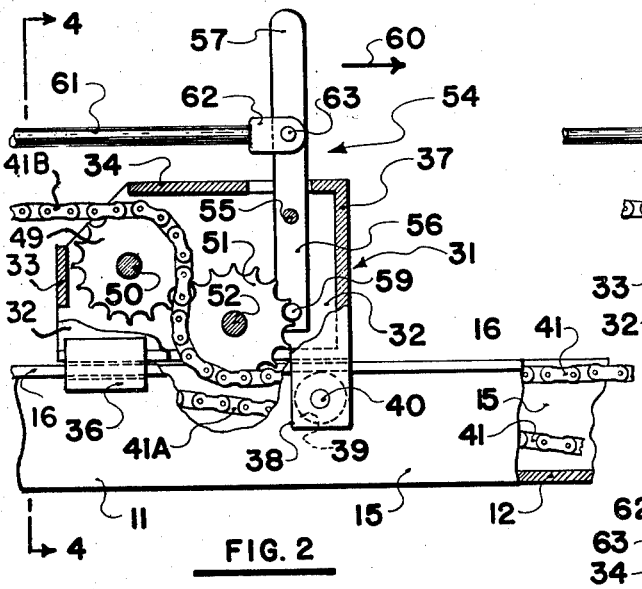
FIG. 2 is a fragmentary partially sectioned side elevation of the carriage per se mounted on the track and with the carriage being in the chained connected mode.
Figure 5:
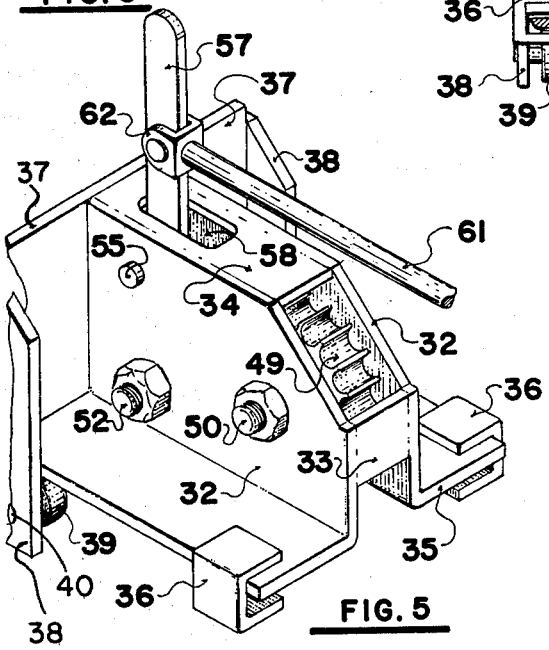
FIG. 5 is an isometric rear view of the carriage per se.

A ram carriage is provided collectively designated 31 and is shown in detail in FIGS. 2 and 5. It consists of a pair of spaced and parallel side plates 32 maintained in the desired position by means of a cross member 33 and an upper cross member 34. Outwardly facing horizontal flanges 35 extend from the lower edges of each of the plates 32 and angle type clips 36 are secured as by welding, to these outwardly facing flanges 35 adjacent the rear side of the flanges 35. These engage under the horizontal flanges 16 forming the track component as clearly illustrated in the drawings. A vertical front plate 37 extends across the front edges of the side plates 32 and include rearwardly extending portions 38. These carry rollers 39 journalled for rotation upon spindles 40 secured adjacent the lower ends of these vertical portions 38 and these rollers also engage under the horizontal flanges 61 as clearly shown in FIGS. 1 and 2 thus mounting the carriage for sliding movement along the track formed by the spaced and parallel horizontal flanges 16.

An endless chain 41 supplies selective motion to the carriage, said endless chain extending around an idler sprocket 42 journalled upon a shaft 43 extending between the two vertical flanges 15 of the angle irons 11, adjacent the front end thereof as clearly shown in FIG. 1, with the chain extending rearwardly in the slot 30 defined by the vertical flanges 15.

A drive sprocket 44 is secured to a shaft 45 which in turn is journalled within a pair of bearings 46 secured to vertically extending brackets 47 extending upwardly from the horizontal flanges of the track, and adjacent the rear end thereof. Diagonal braces 48 extend between the members 47 and the horizontal flanges to support these members 47 and bearings in the desired position. Reference to FIGS. 1 and 6 show this construction.

The lower run 41A of the chain runs directly from sprocket 42 to sprocket 43A whereas the upper run designated 41B, is operatively engaged through the carriage as will hereinafter be described.

A first sprocket 49 is journalled within the carriage between side plates 32, and upon spindle 50 extending between these side plates and a further sprocket 51 is also journalled for rotation between the side plate 32 and upon a shaft or spindle 52 also extending between the side plates and in this embodiment it will be observed that the axle or spindle 52 is in a lower plane than the axle or spindle 50 and that the axle or spindle 52 is situated adjacent the front end of the carriage whereas the axle 50 is situated adjacent the rear side of the carriage. The upper run 41B of the endless chain 41 extends over the first sprocket 49 and then downwardly to engage under the second sprocket 51 as clearly shown in FIG. 2.

Figure 2A:
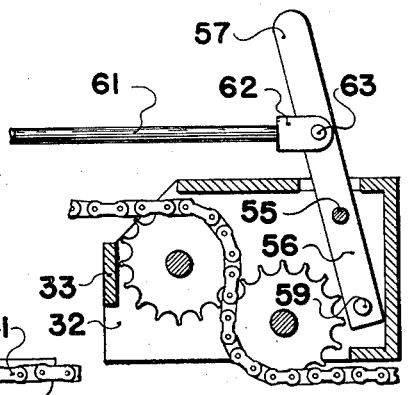
FIG. 2A is a view similar to FIG. 2 but showing the carriage in the free wheeling mode.
Figure 3:
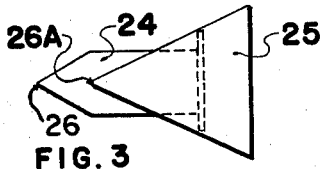
FIG. 3 is a top plan view of the wedge assembly per se.

The endless chain 41 normally moves constantly in the direction of arrow 53 and means are provided to change the carriage from a free wheeling position as shown in FIGS. 1 and 2A, to a chain locked position as shown in FIG. 2 and vice versa.

The last means provided comprises an operating lever collectively designated 54 and pivoted between the side plate 32 of the carriage, upon pivot pin 55 with the lower end 56 extending downwardly between the side plates 32 and the upper end 57 extending upwardly clear of the carriage, through a slot 58 in the top plate 34.

A hardened steel pin 59 is secured to the lower portion 56 of the lever adjacent the lower end thereof and when the lever is in the rear position as shown in FIG. 2A, this pin is clear of the exposed portion of the sprocket 51 so that the two sprockets 49 and 51 are idling with the chain running therearound and enabling the carriage to be moved manually and freely along the track in either direction.

However when it is desired to lock the carriage to the chain, the lever is moved forwardly in the direction of arrow 60 thus engaging the pin between two adjacent teeth of the exposed portion of sprocket 51 thus preventing the sprocket from rotating and locking the carriage to the chain so that it is moved thereby, in the direction of arrow 53 and towards the log 27.

In operation, the log 27 is placed against the wedging portion 26 of the wedge assembly 22 and the carriage, in the free wheeling mode, is moved manually against the rear side 27A of the log whereupon lever 54 is moved in the direction of arrow 60 locking the carriage to the chain which forces the log against the wedge assembly and splits same.

As soon as the log has been split, the lever 57 may be moved manually in a direction opposite to arrow 60 thus disengaging the pin 59 from the teeth of the sprocket 51 thus placing the carriage in the free wheeling mode with the chain continuing to run at a constant speed around sprockets 49 and 51 and around idler sprocket 42.

Means are provided to disengage the carriage automatically, said means taking the form of a link or rod 61 with a fork 62 secured to the front end thereof and being pivotally secured to the upper portion 57 of the lever, by means of pivot pin 63.

This rod passes through an aperture 64 formed in a cross member 65 of a support frame 66 extending upwardly from the horizontal flanges as clearly shown in FIGS. 1 and 6 and a stop assembly 67 is provided on the rear end of the rod assembly on the other side of the support frame 66. This stop assembly may take the form of a pair of nuts 68 screw threadably engaging the rear end 69A of the rod 61 so that a certain adjustment is provided. When these nuts strike the cross member 65 surrounding the aperture 54, the lever is pulled rearwardly in the direction opposite to arrow 60 thus disengaging the pin 59 from the sprocket teeth and stopping the forward motion of the ram carriage 31.

Figure 7:
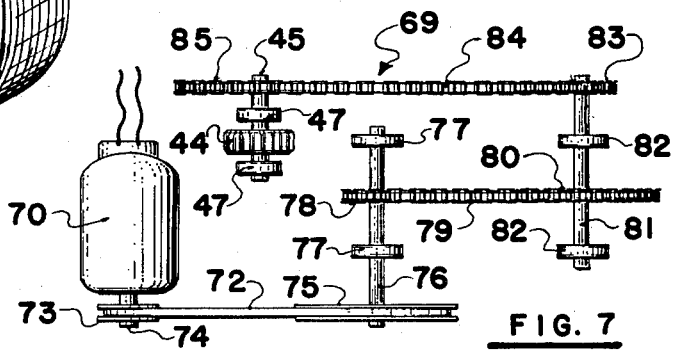
FIG. 7 is a plan schematic view showing the drive connections between the source of power and the endless chain.

The drive shaft 45 is driven through a gear reduction assembly collectively designated 69 and shown schematically in FIG. 7 and partially in FIG. 6. The source of power preferably takes the form of an electric motor 70 slung below the frame by means of supports 71 and being connectable to a conventional source of electrical power such as 110 VAC.

A drive belt 72 extends around a drive pulley 73 on the end of the motor shaft 74 and this drive belt extends around a larger pulley 75 secured to a shaft 76 supported within bearings 77 on the frame of the assembly.

A relatively small sprocket 78 is also secured to shaft 76 and a drive chain 79 extends around this sprocket and around a larger sprocket 80 secured to shaft 81 supported within a bearing 82 on the frame. A relative small sprocket 83 is also secured to shaft 81 and a sprocket chain 84 extends around this small sprocket 83 and around a larger sprocket 85 secured to the main drive shaft 45 to which sprocket 44 is secured thus giving the necessary reduction to enable a relative small fractional horsepower motor 70 to provide sufficient force in order to split log 27.

If the hitch assembly 20 is provided, it is relatively easy to move the device from one location to another by hitching the same to the rear of an automobile, truck or the like.

Preferably, a cover 86 is hinged to the rear of the frame as by pivots 87 and may be swung rearwardly to the position shown in FIG. 1 thus uncovering the drive assembly. Alternatively it may be swung over in the direction of arrow 88 to rest upon the horizontal flanges 16 at the rear end thereof thus covering the drive assembly for safety purposes and to prevent dirt, dust and the like from reaching same.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A log splitting assembly having a source of power and comprising in combination a frame including a track component mounted thereon, a fixed wedge assembly on one end of said track component, a ram carriage on said track component, means mounting said ram carriage for sliding movement along said track component in either direction, an endless chain mounted within said frame and being operatively connected to the source of power, means in said frame mounting said endless chain for movement by said source of power, sprocket means mounted for rotation in said ram carriage, said endless chain engaging around said sprocket means, said carriage being movable from a free wheeling mode to a chain connected mode and vice versa, and means co-operating with said carriage to change said carriage from said free wheeling mode to said chain connected mode and vice versa, said carriage, when in said free wheeling mode, being movable manually in either direction along said track component and being operatively fixed to said chain for movement therealong said track component, when in said chain connected mode.

2. The assembly according to claim 1 in which said sprocket means mounted in said carriage includes at least one sprocket mounted within said carriage, said endless chain passing around said sprocket whereby a part of said sprocket is exposed and not engaged by said chain.

3. The assembly according to claim 1 which includes first and second sprockets mounted in said carriage, said endless chain passing around said sprockets whereby a part of at least one of said sprockets is exposed and not engaged by said chain.

4. The assembly according to claim 2 in which said means co-operating with said carriage to change said carriage from a free wheeling mode to a chain connected mode and vice versa includes a lever pivoted adjacent one end thereof to said carriage, and extending therefrom, and means extending from said lever engaging between two adjacent teeth of the exposed part of said sprocket, when said lever is moved to the chain connected mode.

5. The assembly according to claim 3 in which said means co-operating with said carriage to change said carriage from a free wheeling mode to a chain connected mode and vice versa includes a lever pivoted adjacent one end thereof to said carriage, and extending therefrom, and means extending from said lever engaging between two adjacent teeth of the exposed part of said sprocket, when said lever is moved to the chain connected mode.

6. The assembly according to claim 1 in which said track component includes a pair of flanges one on either side of said track component, said means mounting said carriage for sliding movement there along including flange engaging clips on the rear end of said carriage and rollers journalled for rotation to said carriage adjacent the front edge thereof and engaging under said flanges.

7. The assembly according to claim 2 in which said track component includes a pair of flanges one on either side of said track component, said means mounting said carriage for sliding movement there along including flange engaging clips on the rear end of said carriage and rollers journalled for rotation to said carriage adjacent the front edge thereof and engaging under said flanges.

8. The assembly according to claim 3 in which said track component includes a pair of flanges one on either side of said track component, said means mounting said carriage for sliding movement there along including flange engaging clips on the rear end of said carriage and rollers journalled for rotation to said carriage adjacent the front edge thereof and engaging under said flanges.

9. The assembly according to claim 4 in which said track component includes a pair of flanges one on either side of said track component, said means mounting said carriage for sliding movement there along including flange engaging clips on the rear end of said carriage and rollers journalled for rotation to said carriage adjacent the front edge thereof and engaging under said flanges.

10. The assembly according to claim 5 in which said track component includes a pair of flanges one on either side of said track component, said means mounting said carriage for sliding movement there along including flange engaging clips on the rear end of said carriage and rollers journalled for rotation to said carriage adjacent the front edge thereof and engaging under said flanges.

11. The assembly according to claim 1 which includes means operatively extending between said frame and said carriage to change said carriage from the chain connected mode to the free wheeling mode when said carriage reaches a predetermined position relative to said fixed wedge assembly.

12. The assembly according to claim 2 which includes means operatively extending between said frame and said carriage to change said carriage from the chain connected mode to the free wheeling mode when said carriage reaches a predetermined position relative to said fixed wedge assembly.

13. The assembly according to claim 3 which includes means operatively extending between said frame and said carriage to change said carriage from the chain connected mode to the free wheeling mode when said carriage reaches a predetermined position relative to said fixed wedge assembly.

14. The assembly according to claim 4 which includes means operatively extending between said frame and said carriage to change said carriage from the chains connected mode to the free wheeling mode when said carriage reaches a predetermined position relative to said fixed wedge assembly, said last mentioned means including a link secured by one end thereof to said lever and freely engaging through an apertured portion of said frame and adjustable stop means on the other end of said link engaged by said frame when said carriage reaches said predetermined position thereby moving said lever.

15. The assembly according to claim 5 which includes means operatively extending between said frame and said carriage to change said carriage from the chain connected mode to the free wheeling mode when said carriage reaches a predetermined position relative to said fixed wedge assembly, said last mentioned means including a link secured by one end thereof to said lever and freely engaging through an apertured portion of said frame and adjustable stop means on the other end of said link engaged by said frame when said carriage reaches said predetermined position thereby moving said lever.

16. The assembly according to claim 6 which includes means operatively extending between said frame and said carriage to change said carriage from the chain connected mode to the free wheeling mode when said carriage reaches a predetermined position relative to said fixed wedge assembly.

17. The assembly according to claim 7 which includes means operatively extending between said frame and said carriage to change said carriage from the chain connected mode to the free wheeling mode when said carriage reaches a predetermined position relative to said fixed wedge assembly.

18. The assembly according to claim 8 which includes means operatively extending between said frame and said carriage to change said carriage from the chain connected mode to the free wheeling mode when said carriage reaches a predetermined position relative to said fixed wedge assembly.

19. The assembly according to claim 9 which includes means operatively extending between said frame and said carriage to change said carriage from the chain connected mode to the free wheeling mode when said carriage reaches a predetermined position relative to said fixed wedge assembly, said last mentioned means including a link secured by one end thereof to said lever and freely engaging through an apertured portion of said frame and adjustable stop means on the other end of said link engaged by said frame when said carriage reaches said predetermined position thereby moving said lever.

20. The assembly according to claim 10 which includes means operatively extending between said frame and said carriage to change said carriage from the chain connected mode to the free wheeling mode when said carriage reaches a predetermined position relative to said fixed wedge assembly, said last mentioned means including a link secured by one end thereof to said lever and freely engaging through an apertured portion of said frame and adjustable stop means on the other end of said link engaged by said frame when said carriage reaches said predetermined position thereby moving said lever.

21. The assembly according to claims 1, 2 or 3 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

22. The assembly according to claims 4, 5 or 6 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

23. The assembly according to claims 7, 8 or 9 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

24. The assembly according to claims 10, 11 or 12 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

25. The assembly according to claims 13, 14 or 15 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

26. The assembly according to claims 16, 17 or 18 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

27. The assembly according to claims 19 or 20 in which said fixed wedge assembly includes a two stage wedge component, said two stage wedge component including, a first stage and a second stage, said first stage comprising a tapered wedge component with the wedging end facing said carriage, said second stage also comprising a tapered wedge component secured on top of said first wedge component with the wedging end thereof also facing said carriage, said wedging end of said second stage being spaced rearwardly of said wedging end of said first stage whereby said wedging end of said first stage engages the log before said wedging end of said second stage.

* * * * *